United States Patent [19]

Franklin

[11] 3,992,245

[45] Nov. 16, 1976

[54] MACHINE FOR DELIVERING SECONDARY WORK-PIECES TO PRIMARY WORK-PIECES

[76] Inventor: Earl E. Franklin, 3511 Terrace Drive, Omaha, Nebr. 68134

[22] Filed: Nov. 19, 1974

[21] Appl. No.: 525,187

[52] U.S. Cl. ..... 156/571; 198/689; 214/1 BS; 214/8.5 D; 214/1 BH; 221/211; 198/803

[51] Int. Cl.[2] ..... B65C 9/08

[58] Field of Search ..... 156/356, 560, 358, 561, 156/362, 562, 364, 571, 556, 598; 248/362, 363; 269/21; 279/3; 214/1 BS, 8.5 D, 1 BH; 271/9; 221/211; 118/230; 198/209

[56] References Cited

UNITED STATES PATENTS

| | | | |
|---|---|---|---|
| 2,264,628 | 12/1941 | Engert et al. | 156/291 |
| 2,685,323 | 8/1954 | Morey et al. | 198/209 |
| 2,797,010 | 6/1957 | Weer | 156/561 |
| 2,946,370 | 7/1960 | Muttera | 156/562 |
| 3,056,317 | 10/1962 | Huber et al. | 214/1 BS |
| 3,152,720 | 10/1964 | Maloney et al. | 221/211 |
| 3,552,584 | 1/1971 | Heinrich | 214/8.5 D |

*Primary Examiner*—William A. Powell
*Assistant Examiner*—J. J. Gallagher
*Attorney, Agent, or Firm*—Hiram A. Sturges

[57] ABSTRACT

A machine for lifting secondary work-pieces, such as stamp mounts, from stacks on one work-piece support and delivering them to primary work-pieces, such as catalog pages, on a second work-piece support by means of vacuum-operated intermittently moving pick-up members, the two work-piece supports automatically moving with respect to each other between each delivery motion of the pick-up members.

24 Claims, 21 Drawing Figures

MACHINE FOR DELIVERING SECONDARY WORK-PIECES TO PRIMARY WORK-PIECES

FIELD OF THE INVENTION

This machine is in the field of machines adapted to deliver secondary work-pieces to primary work-pieces automatically in a precise manner.

DESCRIPTION OF THE PRIOR ART

In the prior art it has been necessary for secondary work-pieces, such as stamp mounts, to be delivered to primary work-pieces, such as catalog pages, by hand-labor in the absence of a suitable machine. A part of the reason for this is the necessity for the exact positioning of the stamp mounts with their rectangular edges parallel to the edges of the catalog page. Complexity is involved because there are many stamp mounts on the same catalog page and the mounts are for different types of stamps and, therefore, often have different sizes and go into different positions on a catalog page.

Also, a suitable machine has been needed to eliminate hand-labor costs in the making of ornamental collages of overlapping abutting stamps.

Another objective is to provide a machine generally as described but having special vacu-holders thereon for holding by vacuum the secondary-work-pieces that are delivered in successive deliveries to the vacu-holders so as to cause the secondary work-pieces to be held in pattern with respect to each other as is useful for making an ornamental collage of overlapping stamps when the stamps themselves are handled as are the secondary work-pieces in the description hereinabove.

SUMMARY OF THE INVENTION

A material handling machine comprising primary and secondary work-piece supports mounted on a frame and intermittently moving with respect to each other, a plurality of secondary work-piece upholding surface means spaced apart with respect to each other and mounted on the secondary work-piece support and having wall assembly means thereon for holding stacks of secondary work-pieces, a primary work-piece receiving surface means mounted on the primary work-piece support, a plurality of secondary work-piece pick-up assembly means mounted one at each of said secondary work-piece supports and each having one or more pick-up members each having a suction opening therethrough to which latter vacuum conduit means is attached on which a vacuum is drawn by an air compressor and in a manner controlled by timing switch means for maintaining a vacuum thereon during an interval in which the pick-up member is moved from a position of picking up a secondary work-piece to a position for depositing a secondary work-piece on a primary work-piece after which the vacuum is released, and controllable drive means for automatically moving said primary and secondary work-piece supports with respect to each other a certain distance between each of said secondary work-piece pick-up and release motions of said secondary work-piece pick-up assemblies.

The combination described in which a cam switch assembly of the rotating cam type is used to operate switches controlling solenoids which control vacuum for said pick-up members and air pressure for driving said work-piece supports with respect to each other.

An object is to provide for the machine either pin means for receiving thereon primary work-pieces to hold them on place on the primary work-piece support or else vacuum holders having perforated upper surfaces, a means thereunder through which a vacuum can be drawn so that work-pieces can be held against the perforated upper surface means at desired times as synchronized by connection with an air compressor and controlled by solenoid valve means operated by an automatic switching assembly.

A further object is to provide a pick-up assembly having a vertically moving upholding means telescopically mounted on a post assembly for vertical movement with respect thereto, the upholding means having the pick-up member described at its lower end, and a spring urging the upholding means downward so as to cause the respective pick-up member to be resiliently urged downward.

An important concept is the provision of means in the pick-up assemblies for preventing rotation of portions thereof on which the pick-up members are mounted with respect to other portions thereof so that secondary work-pieces, such as stamp mounts can be placed with their edges in exact parallelism with the edges of a stamp catalog page defining a primary work-piece.

A further object is to provide the pick-up members with post assemblies on which they are mounted, the posts of which are adapted to rotate on a vertical axis swinging the pick-up members in an arc from a secondary work-piece pick-up position to a secondary work-piece delivery position as described. This mechanism is in combination with means for causing the post to raise just before a swinging motion for delivery and just before swinging motion for return, and to lower just after the swinging motion for delivery and immediately after the swinging motion for return.

An object is to provide a machine with an automatic primary work-piece feeding station adapted to delivery primary work-pieces from a stack thereof over on to said primary work-piece support as accomplished by a pick-up member assembly and rotating post assembly system as described.

A further object is to provide the machine with a removal station of similar construction as described for the feeding station, but synchronized for removing primary work-pieces from the primary work-piece support after the primary work-pieces have passed by all other stations of the machine which operate thereon.

Still a further object is to provide a gluing assembly provided with means thereon for automatically applying glue to a primary work-piece, all automatically synchronized with other parts of the machine for accomplishing this at a time when a primary work-piece is opposite a gluing station.

A particular object is to provide a gluing assembly as described in which the gluing assembly has a stencil through which glue is applied by means of an automatically operating roller controlled indirectly by a special pneumatic cylinder having cables extending through each of its ends and indirectly connected to a frame supporting the roller, inner ends of the cable being attached to a piston, and pneumatic pressure being maintained in the cylinder by the provision of special sealing means in the form of nylon seals having openings therethrough slidably receiving said cables at each end of the gluing cylinder whereby the cables can function to move the roller by having the cables extended across inner and outer pulleys whereby reciprocation of the piston resuls in reciprocation of the roller, all as automatically controlled by suitable switching means, preferably rotating cam operated switching means controlling solenoid valve means for pneumatically operating the gluing cylinder.

BRIEF DESCRIPTION OF THE DRAWINGS

FIG. 4 having an illustrative stack of primary work-pieces shown thereon in dotted lines and having parts broken away and other parts diagramatically shown for convenience of illustration.

DESCRIPTION OF THE PREFERRED EMBODIMENTS

Figure 1:
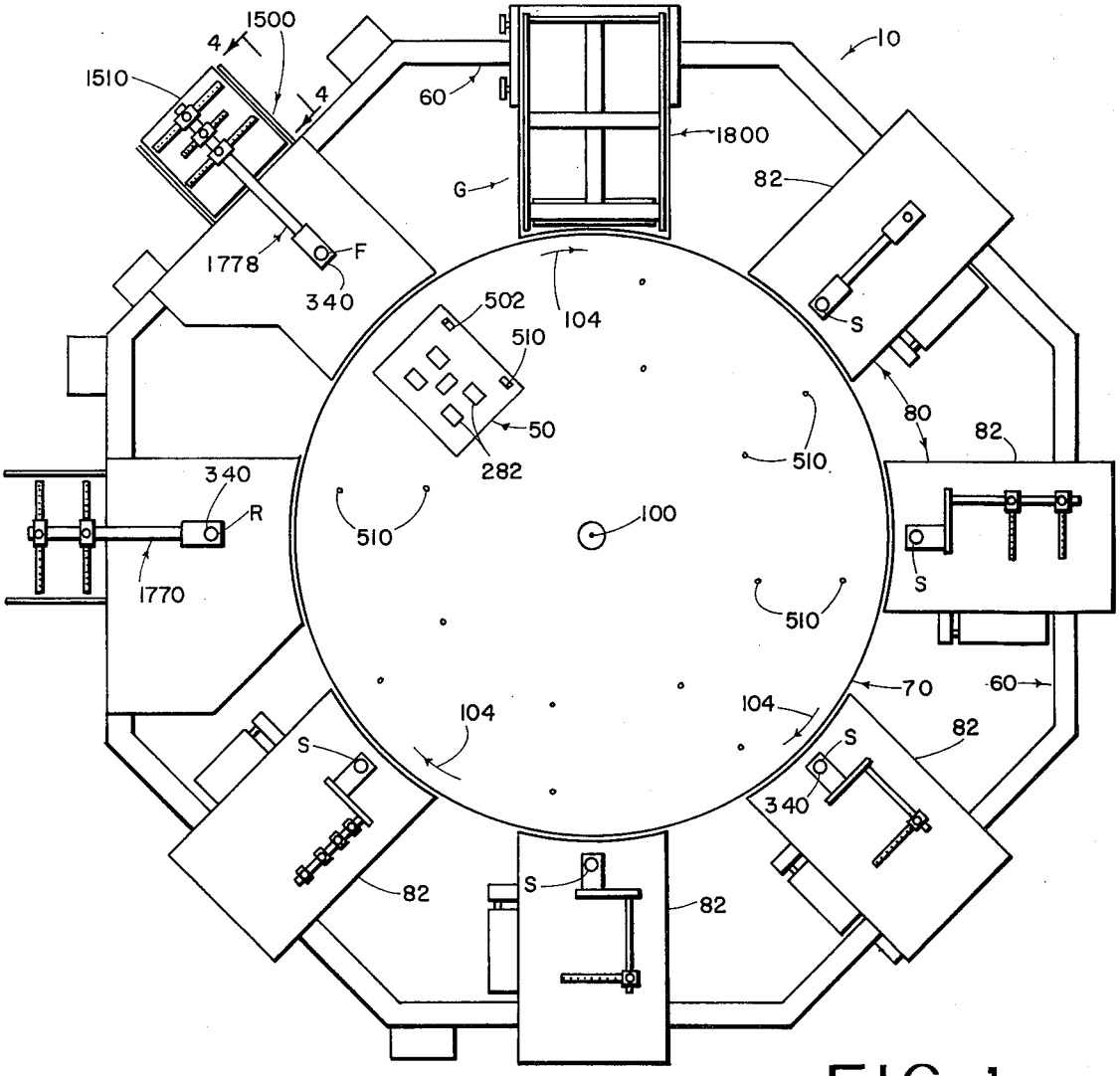
FIG. 1 is a top plan view of the material handling machine of this invention shown with a single catalog page in place thereon and with secondary work-piece pick-up assemblies, each in an initial position above a secondary work-piece upholding surface means, with feeding station pick-up assembly disposed above a feed stack area, and with removal station pick-up means disposed above a delivered stack area.
Figure 3:
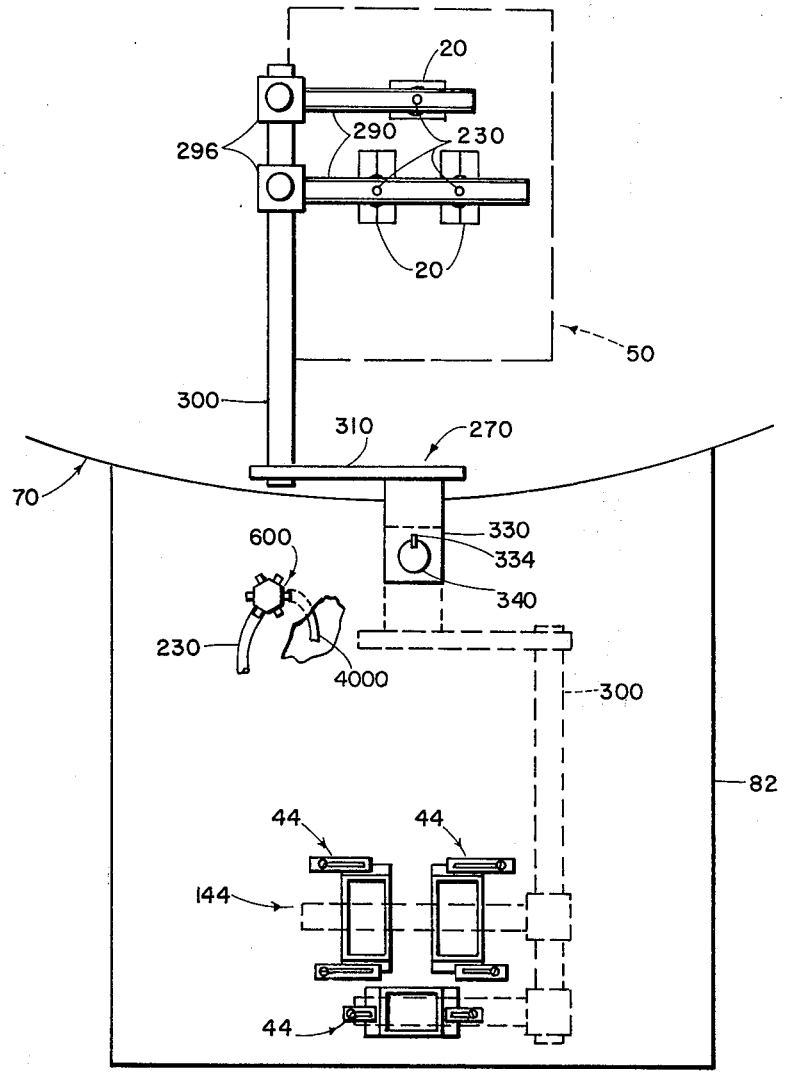
FIG. 3 is a top plan view of a typical secondary work-piece pick-up assembly showing its secndary work-piece upholding surface means on which secondary work-piece holding assemblies are shown, a primary work-piece support or rotating table being diagramatically shown only as indicated by an arcuate line, the secondary work-piece pick-up assembly of FIG. 3 being shown in full lines in a delivery position above a primary work-piece, which latter is shown in dotted lines, secondary work-pieces being shown held to the pick-up assembly just prior to release, a dotted line position of the pick-up assembly being its initial secondary work-piece pick-up position, FIG. 3 being a view with the center of the primary work-piece support table being directly beyond the top of the view.
Figure 12:
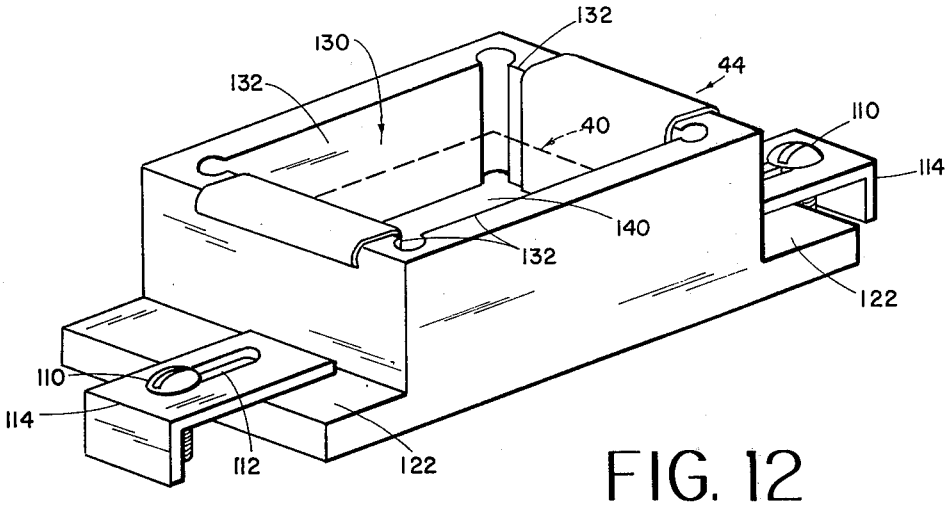
FIG. 12 is a perspective view of a secondary work-piece holding assembly with the outer edge of an uppermost secondary work-piece of a stack thereof having its position indicated in dotted lines.
Figure 13:
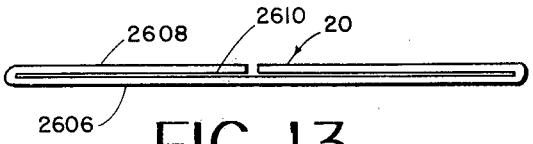
FIG. 13 is a edge view of a horizontally disposed stamp mount, which latter is a typical secondary work-piece for the machine hereof.

The material handling machine of this invention is generally indicated at 10 in FIG. 1 and is for the purpose of lifting secondary work-pieces 20, such as the secondary work-piece example shown in FIG. 13, which is a transparent plastic stamp mount or secondary work-piece 20 from one or more stacks of secondary work-pieces 20, one such stack having its upper surface indicated at 40 in dotted lines in FIG. 12 as received in a secondary work-piece holding assembly generally indicated at 44 in FIG. 12 and others being seen at 44 in FIG. 3.

The purpose of the machine is for moving the secondary work-piecess 20 from their holding assemblies 44 and placing them on a primary work-piece generally indicated at 50 in FIG. 1, and more particularly, on many primary work-pieces, as later described.

The machine 10 has a frame 60 on which is mounted a primary work-piece support 70 which is in the form of a rotating circular table or primary work-piece support 70, seen in FIG. 1, and disposed in the center of the machine. A secondary work-piece support is generally indicated at 80 and comprises a plurality of secondary work-piece upholding surface means 82, each of which is spaced apart with respect to the others. In the illustration shown in FIG. 1, secondary work-piece upholding surface means 82 occupy somewhat more than 225° around an axis 100 of rotation of the primary support or rotating table 70.

Means later described cause the primary work-piece support 70 to rotate in the direction of the arrows 104. The secondary work-piece holding assemblies 44 of FIG. 3 are secured to the respective secondary work-piece support 82 by means of removable bolts, best seen at 110 in FIG. 12, each bolt 110 being disposed in an adjustment slot 112 of a bolting bracket 114 adapted to clamp the work-piece holding assembly 44 down by engaging flanges 122 thereof.

Each work-piece holding assembly 44 has a wall assembly thereon generally indicated at 130 in FIG. 12 and preferably comprising four walls 132 on the four sides of a rectangular configuration and bounding a stack area generally indicated at 140 for holding a vertical stack 40 of the secondary work-pieces 20, as seen in FIG. 12.

Three individual work-piece holding assemblies 44 are shown in FIG. 3 in a group or cluster generally indicated 144, such a group being identified as being on a single one of the secondary work-piece upholding surface means 82, which later could also be called a secondary work-piece station 82, there being five such stations 82 in the illustration shown in FIG. 1.

Figure 2:
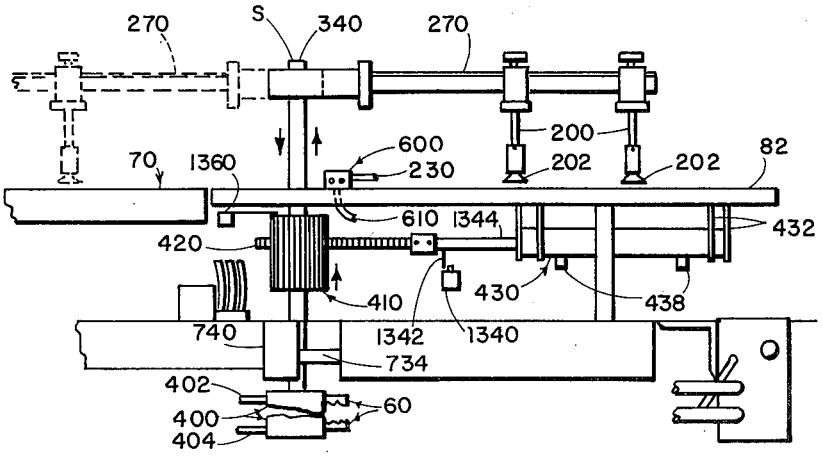
FIG. 2 is a side elevation of the typical secondary work-piece pick-up station and as seen from the left-hand side of FIG. 3, but with the outermost portion of a pick-up assembly shown in delivery position in dotted lines with the outermost portion broken away, and with the pick-up assemblies shown in full lines in secondary work-piece pick-up position, secondary work-pice holding assemblies not being shown in FIG. 2, and certain other parts being broken away.

In FIG. 12 the stack space 140 is rectangular and the wall assembly 130 is open at its upper side so as to allow a respective one of many pick-up members 202 of many pick-up assemblies 200, such as seen in FIG. 2, to enter through the top thereof to engage an upper one of the secondary work-pieces 20. Each pick-up member 202 has a suction opening 212 extending vertically therethrough, as best seen in cross-section in FIG. 9, the opening 212 being in communication with the passage 220 for vacuum which extends completely through the respective pick-up assembly 200 to an upper end thereof at which the passage 220 is connected to a flexible suction hose 230 leading to suction means later described. In a larger sense, the passage 220 and the hose 230 and parts later described and associated therewith comprise a pneumatic conduit means generally indicated at 250 in Figure, which latter is connected to the suction opening 212 in the pick-up member 202.

Figure 9:
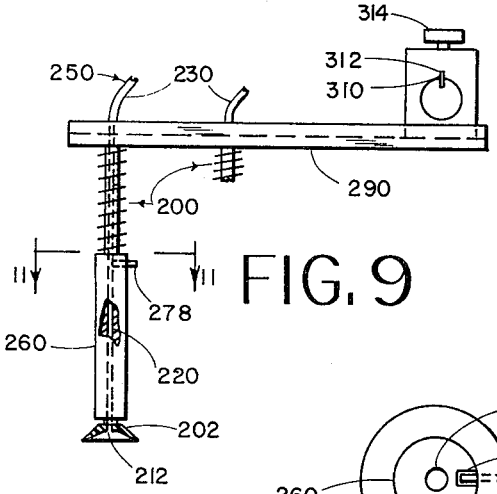
FIG. 9 is a detail of the outer end portion of a pick-up assembly as it would be seen from the right-hand side in FIG. 2, certain portions being broken away and other portions being shown in section and vacuum hoses having portions broken away.

Each pick-up member 202 is preferably made of a flexible material, such as rubber, and is attached to the lower end of a vertically movable upholding member 260, seen in FIG. 9, in which latter the passage 220 partially extends and extends completely therethrough. The upholding member 260 vertically moves with its pick-up member 202 telescopically on a vertical pipe 262, seen in FIG. 10, which latter forms a part of a post assembly generally indicated at 270 and later described. It is to the pipe 262 that the hose 230 is attached, as seen in FIG. 10.

A spring 274 bears against the upper side of the upholding member 260 and urges it downwardly with respect to the pipe 262 for providing further yielding engagement with work-pieces.

Figure 10:
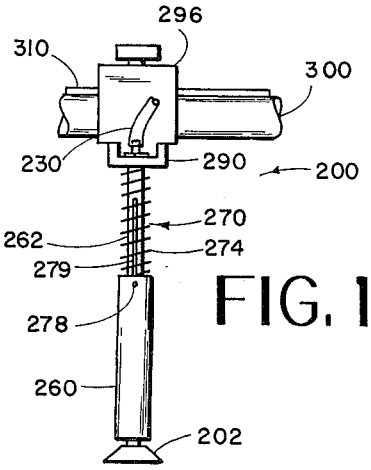
FIG. 10 is a detail showing the parts of FIG. 9 as they would be seen from the left-hand side with portions of an outwardly extending member, having a keyway, broken away and other parts shown.
Figure 11:
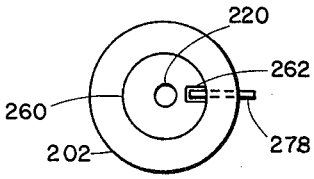
FIG. 11 is a sectional view taken along the line 11—11 of FIG. 9.

Referring to FIG. 10, a track follower pin 278 is there shown and it extends inwardly of the upholding member 260 so as to engage in a vertical slot 279 in the outer surface of the pipe 262 so as to prevent the upholding member 260 and the pick-up member 202 from rotating with respect to the post assembly 270 so that the secondary work-pieces carried by the pick-up assembly 200 can be delivered to the primary work-piece 50, seen in FIG. 1, into precise position for stamp mounts on the latter, such positions being indicated on the catalog page or primary work-piece 50 in FIG. 1 by printed rectangular lines 282 which outline areas which are ordinarily printed to indicate the type of stamp that is to be mounted there.

The post assembly 270 in FIG. 10 preferably comprises a first horizontal member 290 which can be a channel having its hollow side upwardly facing and fixed to a slider 296, which latter slides on a second horizontal member 300 having a keyway 310 on its upper side engaging in a slot 312 in the slider 296 to prevent rotation. A set screw 314 extending through the slider 296 holds it to the second horizontal member 300.

As best seen in FIG. 3, each second horizontal member 300 is connected to a third horizontal member 310 in a rigid manner and the latter extends parallel to the first horizontal member 290, being rigidly fixed to an attachment fitting 330 attached by keying means 334 to a vertical post 340 which is best seen in FIG. 2 and which extends downwardly through and rotates with respect to the respective secondary work-piece upholding surface means 82.

The post 340 extends downwardly to and is attached to a portion of the frame 60, as best seen in FIG. 2, but it is attached rotatably by means of an air cylinder 400 having air hoses 402 and 404 extending therefrom for the control thereof in a manner later described. The post 340 has mounted thereon a vertically elongated gear 410 which is for the purpose of rotating the post 340, and the rack 420 rotates the gear 410. The rack 420 is mounted on and controlled by an air cylinder assembly 430, which latter is fixed by suitable means 432 to the respective secondary work-piece upholding surface means 82 and has hoses 438 leading from it for controlling it in the sequence later described. The purpose of the air cylinder 430 is to cause the rack 420 to rotate the gear 410 fixed to the post 340 to cause the post 340 to rotate in a manner for swinging the respective entire post assembly generally indicated at 270 in FIG. 2 from the full-line position thereof which is the secondary work-piece pick-up position over to the dotted line position thereof which is the delivery position thereof.

The gear 410 is elongated so that it maintains itself in operative connection with the rack 420 regardless of its vertical position, since its initial position at the time of pick-up of a secondary work-piece is for it to be low enough for the pick-up members 202 to engage the primary work-pieces in a stack indicated at 40 in FIG. 12. Thereafter, the entire post assembly 270 is raised by the air cylinder 400 so as to lift the secondary work-pieces 20 out of the holder 44 of FIG. 12 and swing them over into positions above the primary work-pieces 50 on the primary work-piece support 70.

At this point it should be explained that although only one primary work-piece 50 is shown in FIG. 1, yet many more can be placed thereon. In the example shown in FIG. 1, the primary work-piece 50 is a catalog page having pin-receiving openings 502 in one edge thereof which receive pins 510 therethrough for getting good alignment. Precise positioning is accomplished because the pins 510 protrude above the table or primary work-piece support 70 and the catalog pages or primary work-pieces 50 are exactly placed on the pins.

The pins are arranged in pairs and each pair is spaced apart around the circumference of the circular primary work-piece support 70 in the same exact spacing as are the posts 340 of the pick-up assemblies 270.

The pick-up hoses 230 of FIGS. 9 and 10 are flexible and lead to a multiple outlet pick-up hose fitting 600 of which there is one at each of the secondary work-piece upholding surface means 82, each one holding many hoses leading one to each of the pick-up assemblies 200. A vacuum is pulled on each fitting 600 at the right time through a hose 610, seen in FIG. 2, and this vacuum is drawn precisely at the time when the respective pick-up members have engaged the work-pieces 20 which are on top of their respective stacks 40 preparatory to delivering them to the secondary work-pieces.

Vacuum in the hoses 230 ceases after the pick-up members 202 have delivered the secondary work-pieces 20 to the primary work-pieces, which latter is after the posts 340 have made a downward motion as controlled by their air cylinders 400 of FIG. 2.

Vacuum in the hoses 230 remains off until after delivery of a secondary work-piece 20 to a primary work-piece 50 and during and ensuing upward motion of the post 340 and a rotation thereof for swinging the respective entire post assembly 270, seen in FIG. 10, back to a position disposed above the respective work-piece holding assembly 44 or assemblies 44 above the respective secondary work-piece receiving surface means preparatory to a new pick-up and delivery.

All of the posts 340 make these rotations in unison in each direction, as described. They are synchronized through their respective rotation controlling air cylinders 430, seen in FIG. 2 and in FIG. 19. The length of a complete stroke of the piston of any one of the rotation controlling air cylinders 430 is exactly sufficient in a forward or rearward direction, either, one to accomplish exactly a 180° rotation of the respective post 340.

Figure 19:
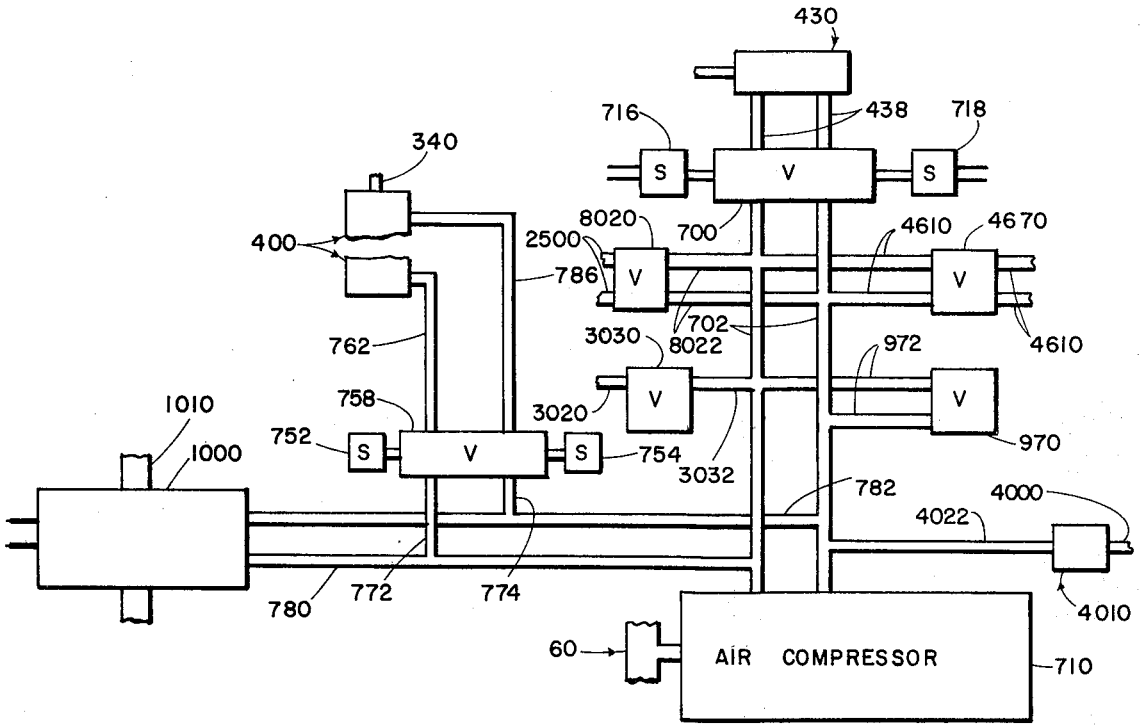
FIG. 19 is a diagram of the pneumatic system for the apparatus.

Each rotation controlling cylinder 430 receives its compressed air through lines 438, seen in FIG. 19, from a distributing valve 700, of which there are a total of eight on the machine in the form shown in FIG. 1, since there are eight of the posts 340 to be controlled. The distributing valve 700 receives its compressed air through lines 702 which lead from an air compressor 710, shown in FIG. 19 only, and disposed beneath the rotating primary work-piece support or table 70 of FIG. 1. The air compressor 710 can be suitably mounted upon a portion of the frame, as shown at 60 in FIG. 19.

Figure 21:
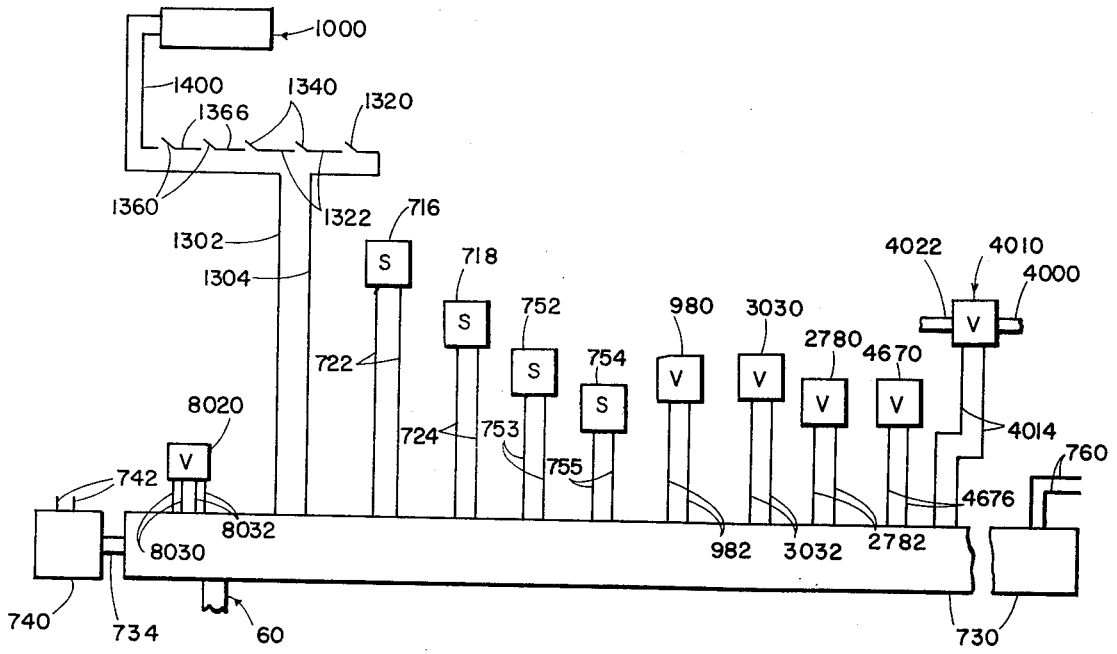
FIG. 21 is a diagrammatic wiring diagram of sample solenoid valves and switches.

Each solenoid distributing valve 700 is controlled by two solenoids 716 and 718, seen in FIG. 19, and these are seen in a diagrammatic wiring diagram in FIG. 21 to be connected by wires 723 and 724 respectively to a cam switch assembly 730, which latter is of the type having multiple cams on a same timing shaft for synchronous rotation, the shaft being seen at 734 and a motor operating the shaft being shown at 740 in FIGS. 2 and 21. Each cam in the assembly 730 closes a microswitch, the cams and microswitches not being shown, for making it possible for power from power wires 760 leading to the switch assembly 730 to be delivered to the solenoids 716 and 718 at the precise times herein described, and so the solenoids 716 and 718 cause the rotation controlling cylinder 430 to which they are connected to rotate its post 180° inwardly over the table of primary work-piece support 70 only after the cam switch assembly 730 has first delivered power to a respective one of two solenoids 752 and 754 for causing a distributing valve 758 to deliver compressed air through a line 762 for raising the respective post 340 by elongating the air cylinder 400 controlling its height.

Compressed air reaches the valve 758 through pneumatic lines 772 or 774 connected to pneumatic lines 780 and 782 which latter connect to respective ones of the pneumatic lines 702 from the air compressor 710.

During upward motion of a post 340 compress air passes backward from the respective height control cylinder 400 through a line 786 back to the valve 758.

It is to be understood that there are eight of the valves 758 with cooperating solenoids, eight of the air cylinders 400, eight of the posts 340, eight of the rotation control cylinders 430, and eight of the valves 700 and their controlling solenoid. FIG. 19, therefore, shows only a representative sample of these parts, repition being pointless.

After the posts 340 have completed their 180° rotation for swinging the pick-up assemblies 270 inwardly, the cam switch assembly 730 will cause the respective one of the solenoids 752 and 754 to operate the valve 758 in a manner for causing the posts 340 to move downwardly for depositing a secondary work-piece onto a primary work-piece in a precise position.

Thereafter, cam switch assembly 730 will operate through respective ones of the solenoids 752 and 754 to cause the height control cylinders 400 to raise the posts 340 preparatory to a return swing of the pick-up assemblies. Thereafter, the cam switch assembly 730 will cause respective solenoids 716 and 718 to operate for causing the fast rotation controlling air cylinder 430 associated therewith to make a return swing of the pick-up members by rotating the post 340 attached thereto exactly 180° because that is the limit of operation of the piston motion of the cylinder assembly 430. Each cylinder assembly 430 makes exactly the same operation as the rest simultaneously therewith for the same reasons.

Figure 17:
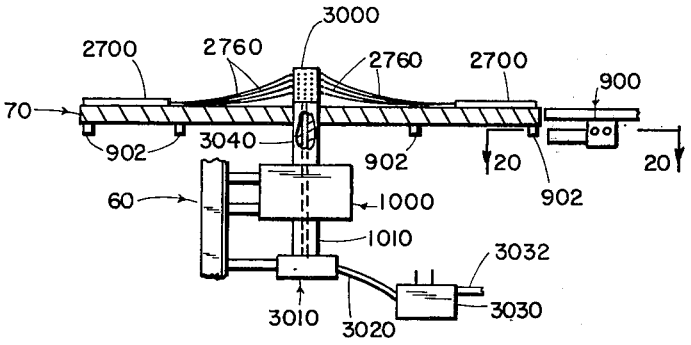
FIG. 17 is a diagrammatic view of a modification of the primary work-piece support or rotating table shown in cross-section with the primary work-piece support mounting and control means shown thereunder with a portion of a frame on which it is mounted, showing a hollow rotating axle for the primary work-piece support with a vacuum supply line extending through it and seen mostly in dotted lines except for a portion where the hollow axle itself is broken away, the vacuum supply line extending upwardly to a multiple vacuum line outlet fitting, FIG. 17 showing a modification of FIG. 1 for use with the vacu-holders of FIG. 16.
Figure 20:
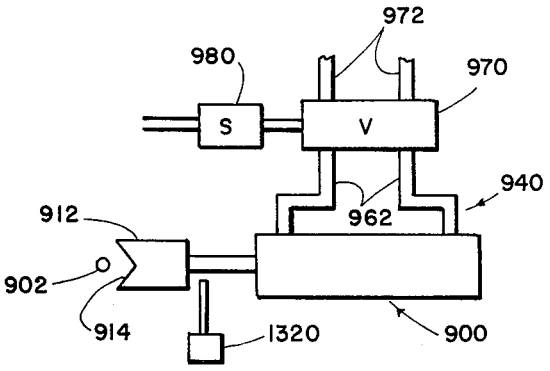
FIG. 20 is a view of a table lock and associated parts.

Referring now to FIG. 17 and also to FIG. 20, a table lock is there shown and generally indicated at 900 and is adapted to cooperate with each sequential one of eight pins 902 which protrude downwardly from the table or primary work-piece support 70.

In FIG. 20, the table lock 900 can be seen to comprise an engaging member 912, which latter has an inner end surface means 914 adapted to cooperate with the pins 902 when the latter are opposite the engaging member 912, the respective cooperative shapes of the rotating table 70 mounted members or pins 902 of the general lock assembly indicated at 940 and comprising the lock 900, develop a cooperative engagement so that, for example, the surface means 914 is a recess having walls forming a V, and the pins 902 are simply cylindrical, then at a time when the engaging member 912 is in tight engagement with a pin 902, the rotating table or secondary work-piece support 70 will be in a precisely fixed position.

The advantage of this is, for example, if the other mechanism described is capable of causing the table or secondary work-piece support 70 to stop within a certain tolerance, as would be affected also by wear on the controlling cam of the cam switch assembly 730, then the table lock assembly 940 will exactly and precisely finish the positioning of the table 70.

The engaging member 912 moves as controlled by an air cylinder 900 which receives its compressed air through lines 962 as controlled by a valve 970 receiving air through lines 972, as seen in FIG. 19, and leading respectively to the lines 702 of FIG. 19.

A solenoid 980 controls the valve 970 and the solenoid 980 is itself controlled by the cam switch assembly 730 through wires 982, as best seen in FIG. 21.

There is only one lock assembly 940 for the entire machine, although there are eight of the pins 902 spaced apart in exact positions for causing the table to be stopped with the primary work-pieces 50 in the precise positions with respect to the posts 340 as necessary for the operation above described.

Referring now to FIG. 21 and also to FIG. 17, it will be seen that a main rotation control mechanism 1000 is mounted on the frame 60 and is attached to a tubular axle 1010 of the rotating table or primary work-piece support 70 so that the main rotation control mechanism 1000 controls rotation of the axle 1010, which latter is fixed to the table or primary work-piece support 70 for causing rotation thereof.

The main rotation control mechanism 1000 is not shown in detail here because such mechanisms are part of the prior art, however, it will be understood to have in it an air motor operating a ratchet and pawl assembly capable of making amounts of rotation of the table 70 which are each exactly one-eighth of a total 360° rotation since there are eight of the posts 340, in the machine shown, for example.

The cam switch assembly 730 controls the main rotation control assembly 1000 by means of delivering current to it as controlled by one of the cams in the assembly 730 and through wires 1302 and 1304 leading from the cam switch assembly 730, one directly to the main rotation control assembly 1000, but the other, the wire 1304 leading through a plurality of safety switches which will now be described.

A table lock retracted switch 1320 is connected to the wire 1304 and to a wire 1322, as seen in FIG. 21, and as seen in FIG. 20, the switch 1320 is a microswitch disposed in a position for being actuated so as to close when the pin-engaging member 912 is in the retracted position safely retracted away from a respective pin 902, as seen in FIG. 20.

In FIG. 20, when the pin-engaging member 912 is in a forward position, a respective pin 902 will be engaging its surfaces 914, as above described, and at such times, the switch 1320 would be open so that no current could reach the main rotation controlling assembly 1000.

A plurality of switches 1340 which are preferably one switch for each post 340 can be called post position safety switches 1340 and are disposed in series with the switch 1320 and with each other by wires 1322, as seen in FIG. 21.

In FIG. 21, only two of the switches 1340 are shown by way of illustration, since two are sufficient to illustrate the operation of eight of them, all eight being in series with the wire 1304 and indirectly connected to a wire 1400 leading to the primary work-piece support main rotation control assembly 1000.

The switches 1340 are disposed one at each air cylinder 430, as seen in FIG. 2. Each switch 1340 is a microswitch adapted to be closed by a member 1342 attached to the piston 1344 of the respective post rotation control air cylinder 430. The switches 1340 are actuated for being closed only at times when the pistons 1344 are retracted, which is at a time when the respective posts are in a rotational position for disposing the pick-up assemblies 200 in original pick-up positions above the secondary work-piece support 82, as best seen in FIG. 2.

At all other times, the switches 1340 are open so that current cannot reach the main primary work-piece support rotation control assembly 1000 to cause rotation at such times.

The switches 1340 are also disposed in series with switches 1360, two of which are illustrated in FIG. 21, but it is to be understood that there is a switch 1360 adjacent each one of the posts 340 so that there are actually eight in number, one switch 1360 being seen in FIG. 2 and being a micro-switch and adapted to be engaged by the gear 410 or other suitable element on the post 340 so that only at times when the post 340 is in an upper position will the switch 1360 be in closed condition so that when the post is down and the pick-up assemblies 200 are down, the table 70 cannot rotate.

As thus described, the switches 1320, 1340 and 1360 are normally open switches which are biased to be open normally.

The switches 1360 are placed in series with the switches 1340 and 1320 by wires 1366 and are in series with the wire 1400, earlier mentioned, leading to the main primary workpiece rotation control assembly 1000, as best seen in FIG. 21.

Figure 4:
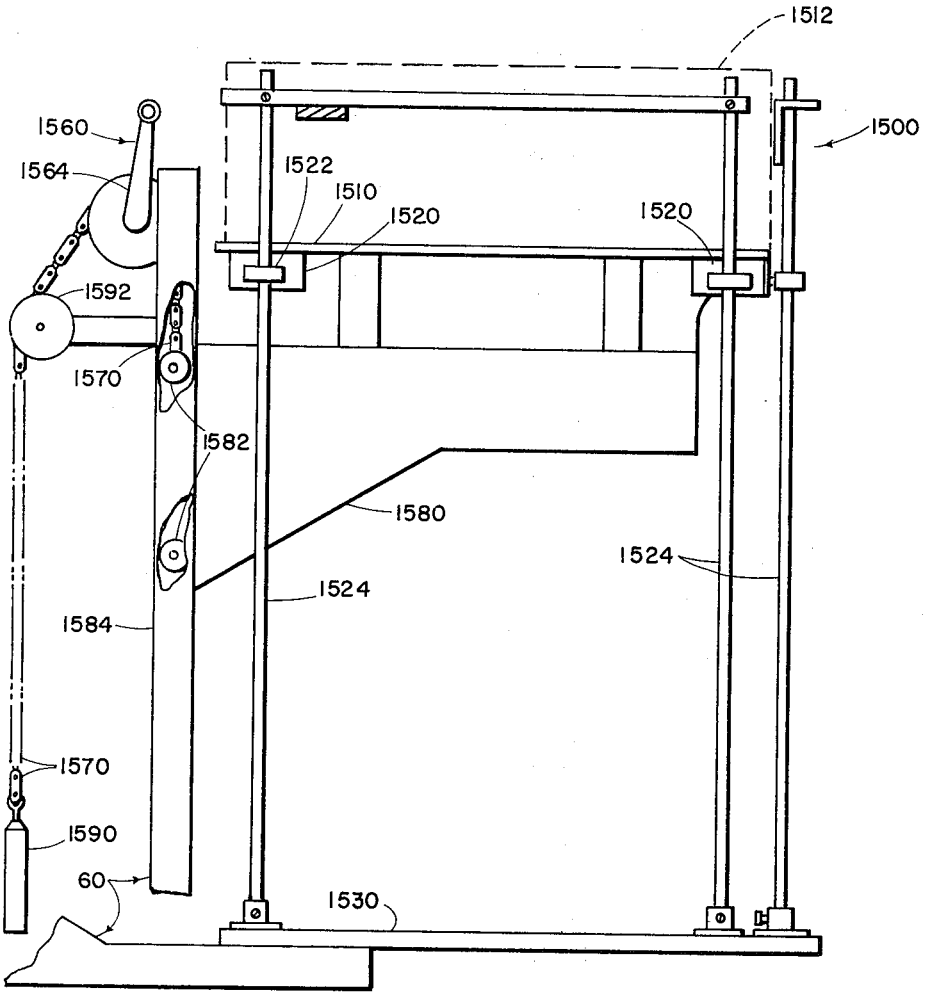
FIG. 4 is a view illustrative of either a feeding station or removal station, either one being shown as it would be seen looking approximately along the line 4—4 of FIG. 1.

Referring to FIG. 1, primary work-pieces are first placed in the machine at a feeding station generally indicated at 1500 and having a stack-holding plate 1510 for upholding a stack of primary work-pieces indicated in FIG. 4 in dotted lines at 1512.

Figure 5:
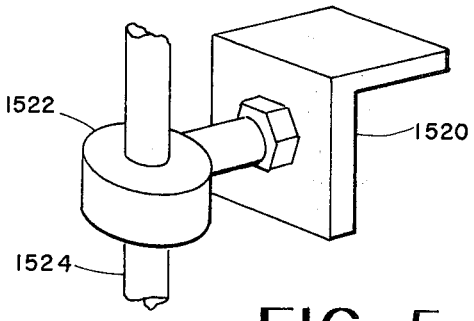
FIG. 5 is a perspective view showing the guide post follower assembly mounted on a broken away section of a guide post of the feeding or removal station of FIG. 4.

The plate 1510 is attached by brackets 1520 to post followers 1522, seen in detail in FIG. 5 as slidably receiving a plurality of vertical posts 1524 fixed to a platform 1530 attached to the frame 60. Since the posts 1524 are vertical, the function of the guide 522 is to cause the stack 1512 to be movable only in a vertical direction and with its upper surface horizontal.

One way to cause the stack holder plate 1510 to be held in position and to be moved upwardly at desired times is to provide a hand-control crank mechanism 1560 mounted on a frame member 60 and having a crank 1564 adapted to move a chain 1570 in each of two directions for moving it upwardly and downwardly on one end which is suitably attached to a plate support bracket assembly 1580 which is fixed to the plate 1510 and raises it and lowers it while wheels attached to the assembly 1580 are guided by a guide post 1584 of the frame 60. A counterweight 1590 can be attached to the chain 1570 and the latter can extend across a pulley 1592 so that the weight of a stack of primary work-pieces on the plate 1510 is counterbalanced.

The function of the feeding station 1500 is to dispose an uppermost primary work-piece 50 of the stack 1512 in a position for being picked up by a pick-up assembly 200 mounted indirectly on a post F shown in FIG. 1 which is one of the posts 340 for pick-up in a similar manner as is done for the secondary work-pieces 20 and FIG. 13 at the secondary work-piece pick-up stations identified by the letter S at the various posts 340 thereof.

Referring to FIG. 1, the machine also has a removal station identified by the letter R on its post 340 and the removal station R has a post assembly connected to it given the numeral 1770 which is similar in all respects to the post assembly 270 described in FIG. 2 with the only exception that more pick-up assemblies 200 are mounted thereon because it is picking up the larger primary work-pieces 50. The post assembly 1778 of the feeding station F can be considered to be identical to the post assembly 1770 of the removal station R.

Since the table 70 rotates in the direction of the arrows 104, the feeding and removal stations are separated by all other stations, whereby all work can be done on the work-pieces complete at the time the primary work-pieces are removed at the removal station R.

At the feeding station T the primary work-pieces 50 are placed on the table 70 in precise positions so that the pins 510 of the table 70 engage respective outermost ends of the openings 502, precise positioning being vital.

Figure 6:
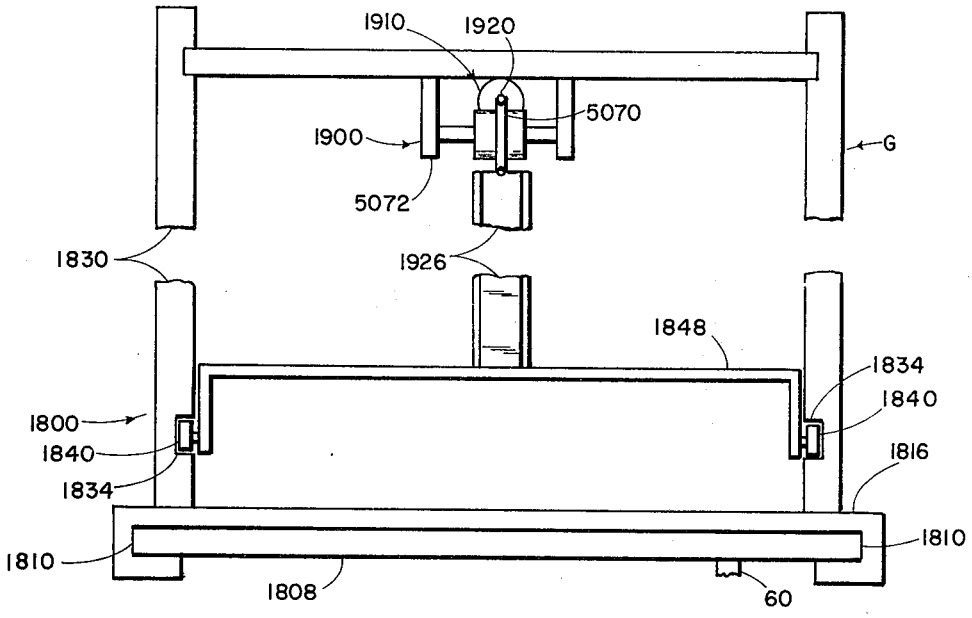
FIG. 6 is a view of the gluing station at the top center part of FIG. 1 as it would be seen in end elevation looking along the line 6—6 of FIG. 1, a roller assembly not being shown in FIG. 6 and parts being broken away for convenience of illustration.

Next, following the feeding station T in FIG. 1 is a gluing station G at which a gluing assembly generally indicated at 1800 is provided and is mounted on the frame 60. In FIG. 6, a gluing station is seen looking at it from the outside of the machine as it would be from the top in FIG. 1 and a track 1808 is there suitably attached to the frame, a part of which is indicated by the numeral 60 in FIG. 6, the track 1808 being a plate of metal with parallel edges 1810 extending inwardly and carrying a track follower 1816 sliding thereon in parallelism with the edges 1810. The track follower 1816 has a gluing assembly frame 1830 mounted thereon which has inwardly facing elongated parallel track grooves 1834 on opposite sides thereof receiving rollers 1840 of a glue roller support frame 1848 which, in FIG. 7, can be seen to have axle means 1852 thereon rotatably supporting a gluing roller 1860 which protrudes downwardly from the frame 1830.

The roller support frame 1848 is caused to move toward and away from the center of the table 70 by means of a cable and pneumatic cylinder assembly generally indicated at 1900 and having a pneumatic cylinder assembly 1910 having its cylinder 1912 fixed to the frame 1830 at 1914; the pneumatic cylinder assembly 1910 being connected to a cable assembly 1920, which latter is drivably connected to the roller carrying frame 1848 by a suitable bracket 1926.

Beneath an inner end of the frame 1830 in a position for being engaged by the roller 1860 is a stencil 2000 which latter is perforated to allow glue to pass through openings therethrough downwardly onto primary work-pieces 50 which are disposed under the gluing station G so as to deposit glue in precise separate positions ideally located for receiving the secondary work-pieces 20 of FIG. 13 thereon directly above a space at which a certain type of a stamp should be mounted on a catalog page of a stamp catalog.

Figure 7:
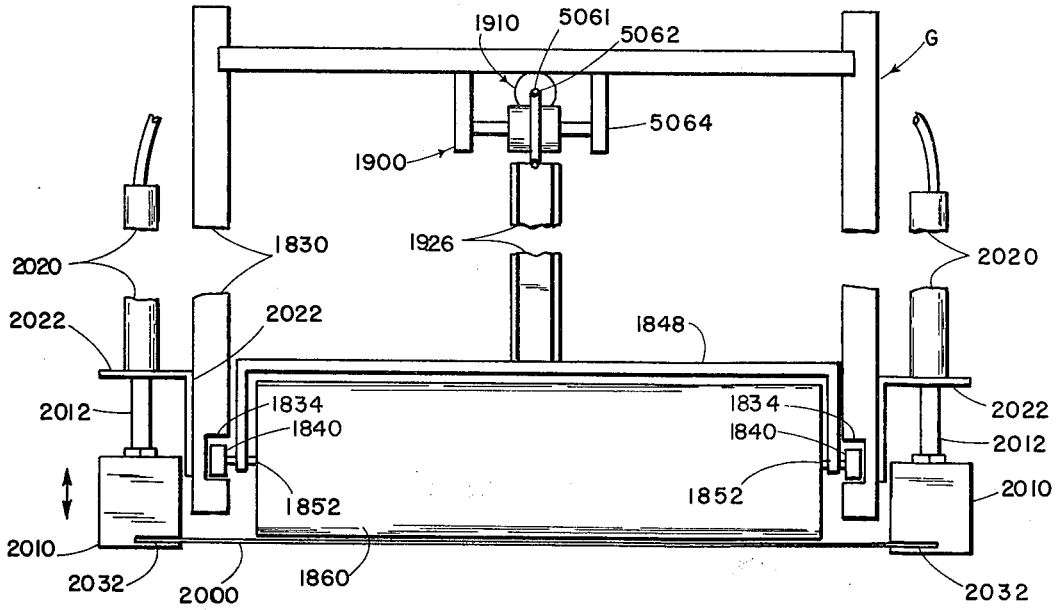
FIG. 7 shows the gluing assembly of FIG. 6 as it would be seen from its opposite end, or as seen from a center of the machine, parts being broken away and the roller being shown in place above a stencil.

The stencil 2000 is carried in right and left slotted carriers 2010 which are disposed on the pistons 2012 of pneumatic stencil control cylinder assemblies 2020, which latter are mounted on the frame 1830 by brackets 2022, as best seen in FIG. 7.

Figure 8:
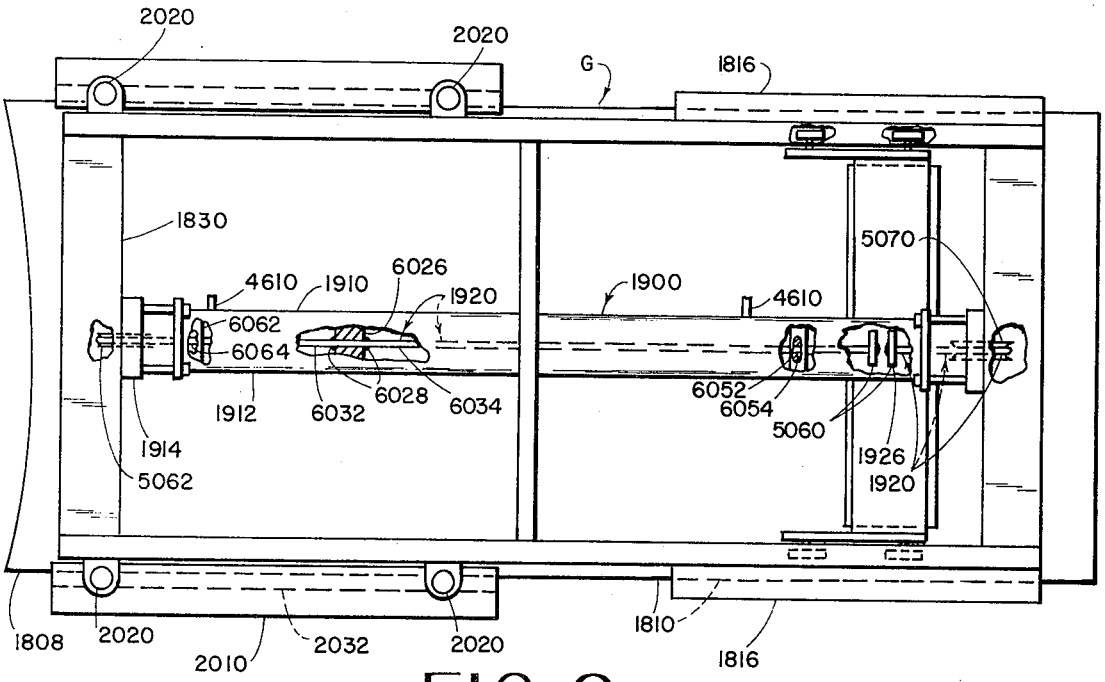
FIG. 8 is a top plan view of the gluing assembly of FIG. 6 and 7 and being in greater detail than FIG. 1, the view being taken with its left end facing the center of the machine, parts being broken away and other parts being shown either in section or in dotted lines, and a paint roller thereof being shown in a retracted position of non-use.

Referring to FIG. 8, it will be seen that the stencil carriers 2010 are elongated and the stencil receiving slots 2032 therein extend from one end to the other because the stencils 2000 are of substantial size.

It is the function of the stencil control cylinder assemblies 2020 to lower the stencil 2000 downwardly against a primary work-piece which is in the position on the table 70 which is opposite the gluing station G only after the entire sliding frame 1830 of FIG. 6 has moved inwardly on its track 1808 sufficiently for the stencil 2000 to be disposed above a work-piece 50 on the table 70.

And so, as best seen looking at FIGS. 1 and 8, it is not only the roller 1860 which must move back and forth across the stencil 2000 for gluing, but also there is a back and forth motion of the entire frame 1830 from its retracted position shown in FIG. 1 to an extended position which it is disposed outwardly across the table 70 for disposing the stencil 2000 above a work-piece 50 retained on pins 510 thereon. So there are reciprocating motions, not only of both the roller and its frame 1848, but also of the entire sliding frame 1830 of the gluing assembly 1800.

Figure 14:
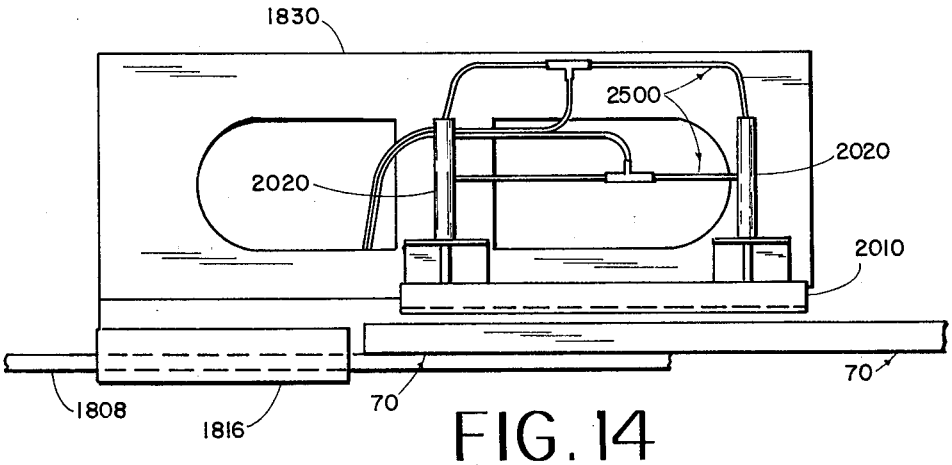
FIG. 14 is a side elevation of the gluing assembly of FIG. 8 as it would be seen from the upper side thereof in FIG. 8, but with the gluing assembly being disposed in an inwardly extended glue-applying position above the rotating table or primary work-piece support.

In FIG. 14 the sliding frame 1830 is shown in an inward position, preparatory to gluing, in which it is disposed overlapping the rotating table 70, although in FIG. 14 the stencil carriers 2010 are disposed in upwardly retracted positions preparatory to being lowered for disposing a stencil 2000 against the upper side of workpiece 50 to be glued.

There are four of the stencil control pneumatic cylinders 2020, as best seen in FIGS. 8 and 14, two for each of the elongated stencil carriers 2010.

A pneumatic line means generally indicated at 2500 controls the stencil cylinders 2020.

The shape of the stencil 2000 could, for example, be not substantially different in appearance than the shape of the rectangular primary work-piece 50 shown in FIG. 1, except for the edge portion thereof that receives the pins 510 with the openings in the stencil 2000 being substantially in positions of the rectangular lines 282 of the catalog page or primary work-piece 50, shown in FIG. 1, with the exception that the glue would be applied in slightly smaller areas within the confines of these rectangular areas 282.

The precise shape of the openings for glue in the stencil 2000 can vary and still the function of good gluing can be performed. Many stencils 2000 would be used in the formation of a single stamp catalog because the work-pieces 50 would vary with the rectangular outlines 282, the positions for stamps varying from catalog page to catalog page, so that a time when one type of page is running in the machine, one type of stencil 2000 is used, and as the pages vary, corresponding stencils are used.

As best seen in FIG. 13, each stamp mount or secondary work-piece 20 can, for example, be of a type having at least one portion 2606 disposed opposite at least one other portion 2608 so that an opening 2610 exists therebetween in which a stamp can be inserted. It is to be understood, however, that this machine is useable with primary and secondary work-pieces of many kinds and descriptions, and for many purposes.

Figure 15:
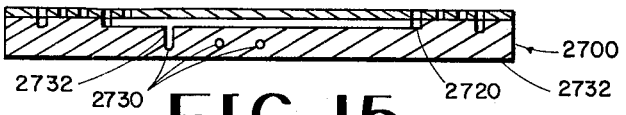
FIG. 15 is a sectional view taken along the line 15—15 of FIG. 16, but with the exception that FIG. 15 is modified to show two extra vacuum grooves, parts of each being shown on each side of FIG. 15.
Figure 16:
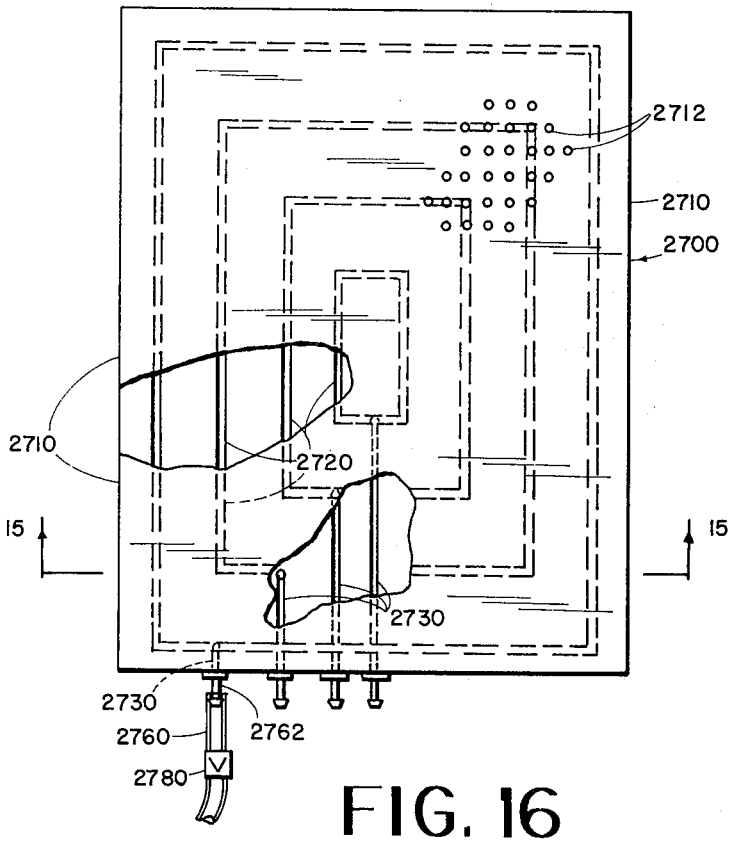
FIG. 16 is a top plan view of a vacu-holder assembly of this invention, shown diagramatically with only a portion of the perforations of the perforared upper plate thereof being shown, portions of the plate being broken away, vacuum grooves in a backing member disposed under the plate being shown partially in dotted lines, a portion of a typical vacuum line for only one of the vacuum fittings on the edge of the vacu-holder being partially shown in cross-section with a valve therein being shown diagramatically.

Referring now to FIGS. 15, 16, 17 and 18, a modification of the machine of FIG. 1 will now be described in which a different construction is used, whereby the pins 510 of the rotating table 70 are no longer necessary, latter modification being valuable in handling primary work-pieces of kinds that would be without the slots or openings 502, and also valuable for many uses such as the assembling of many smaller work-pieces onto a vacuum work-piece holder assembly of this invention which can be called a vacu-holder assembly shown at 2700 in FIG. 16, eight of the assemblies 2700 being used on the rotating table 70, in spaced positions around the table in substantially the places the primary work-pieces 50 would be positioned if they were held on the pins 510 of the modification of FIG. 1.

Figure 18:
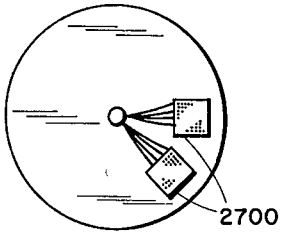
FIG. 18 is a top plan view of the parts shown in FIG. 17 with the exception that the two vacu-holders in FIG. 17 are illustrated as closer to one another to symbolize how they can be freely positioned on the primary work-piece support, all in accordance with the kind of work being done by the machine.

To illustrate this point, without the repetition of showing eight of the assemblies 2700, two opposite ones of the assemblies 2700 are shown in FIG. 17 while two adjacent ones of the assemblies 2700 are shown in FIG. 18.

In FIG. 16, it can be seen that the uppermost part of each assembly 2700 is a perforated flat plate 2710 having preferably evenly dispersed openings 2712 therethrough extending all across the surface of the plate, although for convenience of illustration, not all being shown in FIGS. 16 and 18.

It is actually not vital that the openings 2712 be all across the plate 2710, but that they be disposed above and leading to the different ones of a plurality of rectangular vacuum passages 2720, which latter are disposed one inside another and spaced from each other, as seen in top plan view with the cover plate 2710 partially removed, as seen in FIG. 16.

A vacuum is drawn on each of the passages 2720 by means of lead-in passages 2730, which latter extend horizontally through portions of a passage block 2732 in the upper surface of which the grooves or rectangular passages 2720 are formed, the passages 2720 opening upwardly to the upper edge of the block 2730 and adjacent the underside of the perforated top cover 2712, as best seen in FIG. 15. Vacuum hoses, only one of which is shown at 2760 in FIG. 15, are connected one to each of a plurality of fittings 2762, the latter each being attached to a different one of the lead-in passages 2730. The hoses or vacuum lines 2760 each draw a vacuum on one of the passages 2730 and through the passages 2730 on the grooves 2720 and the openings 2712.

Vacuum can be drawn on all of the grooves 2720 of a vacuum assembly 2700 simultaneously, or it can be drawn only on such ones of the grooves 2720 as require a vacuum at any one time, the selective control of vacuum being possible by having an optional separate solenoid valve 2780 in each vacuum line 2760 connected to its individual lead-in passage 2730.

Apart from that, it is also important that each vacuum assembly 2700 be controllable so as to release its vacuum at a given time while the vacuum is maintained on all other vacuum assemblies. Such a release of vacuum would be useful when a vacuum assembly is disposed opposite the removal station R when it is desired to raise all of the work-pieces from a vacuum assembly at once.

The vacuum lines 2760 are many, and they lead inwardly to a hollow multiple-outlet vacuum fitting 3000 mounted on the top of the hollow axle 1010, as best seen in FIG. 17. The hollow fitting 3000 is connected to a vacuum line 3040 in the hollow axle 1010, the line 3040 leading downwardly to a conventional swivel fitting 3010. The hollow vacuum fitting 3000 rotates with the rotating table 70 as does an inner portion of the swivel fitting 3010 even though the outside portion of the swivel fitting 3010 does not rotate with the table 70 but is fixed to the frame 60, as seen in FIG. 17.

As best seen in FIG. 19, the solenoid valve 3030 is connected by pneumatic line 3032 to the pneumatic line 702, so as to draw a vacuum on line 3032.

Referring now to FIG. 21, the solenoid valve 3030 can be seen to be electrically connected to the cam switch assembly 730 so that a cam thereof and switching means thereof operates the solenoid valve 3030 at the desired time.

The special line valve 2780 for each special line 2760 of FIG. 16, if used, can be controlled by means shown in FIG. 21, such as by connection to the switch assembly 730 for precise timed cam control operation. Although other lines 2760 would have their own valves 2780, these are not shown in FIG. 21 for convenience of illustration, but would operate in the same fashion.

The vacuum holder assembly 2700 of FIG. 16 need not have its top cover 2710 perforated equally all over its surface, but only need be perforated above the passages 2720. However, it will be found to be much less expensive to manufacture the cover 2710 from perforated sheet material available on the market, rather than drilling special holes at high cost above each of the passages 2720.

The passage blocks 2732 stay in place on the table by being fixed thereto by suitable means, for example, they could have recesses up into them from their undersides sufficiently to receive the pins 510 to hold them from shifting. Their weight would hold them down or they could even be glued to the table 70.

The fitting 600 of FIG. 3 has multiple hoses 230 connected to it and each leads to a different one of the pick-up assemblies 200 in a manner shown in FIGS. 9 and 10.

However, vacuum is pulled on the fittings 600 down through the secondary work-piece upholding surface means 82 respectively independently at each fitting 600 of which there is one adjacent each of the posts 340. To illustrate this, in FIG. 3, a hose or other vacuum line 4000 is shown leading to the fitting 600.

Then, over in FIG. 21, a sample solenoid valve 4010 is shown which receives its power from the cam switch control unit 730 through lines 4014 at the proper times in the sequence earlier described for the pick-up of secondary work-pieces, whereby the actuation of the solenoid valve 4010 at each station causes vacuum to pass therethrough from a hose 4022 which leads to a vacuum side of the air compressor 710 to a hose 4000 earlier described, this vacuum ceasing because of a closing of the valve 4010 as controlled by the cam switch 730 at the precise moment when release of a secondary work-piece above a primary work-piece is desired in the sequence above mentioned.

In general, it should be commented that all vacuum and all air pressure in the machine operate from the air compressor 710 in accordance with solenoid valves for all of the purposes described.

Referring to FIG. 8, it will be seen that the gluing station roller control cylinder 1900 has pneumatic lines 4610 going to its ends respectively, and in FIG. 19, the lines 4610 can be seen to lead from pneumatic lines 702 to a solenoid valve 4670, which latter can be seen in the wiring diagram of FIG. 21 to be controlled by the cam switching assembly 730 operating by a special cam, not shown, through the wires 4614 for operating the valve 4670 in a manner for causing reciprocation of the roller in the sequence above described.

The cam switching assembly 730 can be one for the entire machine, or can be a multiple thereof, such as one disposed at each of the eight stations around the machine, although economy is achieved by having a single cam switching assembly 730.

The unit 1000 is to be understood as containing a solenoid valve controlling its air motor operated ratchet and pawl mechanism, the solenoid valve therein, not shown, being operated through the wires 1302 and 1400 of FIG. 21.

Referring to FIG. 7, it is to be understood that the cable 1920 has its ends connected to the bracket 1926 for pulling the gluing roller. Between the connected ends 5060 of the cable 1920, best seen in FIG. 8, the cable is continuous having one end leading from the U-shaped bracket 1926 forwardly around the innermost end of an inner pulley 5062 mounted on the frame 1830 by a pulley mounting assembly 5064, the pulley 5062 rotating in a vertical plane about a horizontal axis with its upper end in substantial alignment with the center of the cylinder 1900 and extending into the end of the cylinder 1900. In other words, the other end of the cable also leads from the bracket 1926 horizontally across the underside of the cylinder 1900 and up around the outer side of an outer pulley 5070, the latter being mounted by a pulley mounting assembly 5072 on the frame 1830, as best seen in FIG. 6. On the outside of the outer pulley 5070, the cable 1920 comes up and over the pulley 5070 and enters directly into the center of the outer end of the cylinder 1900, as best seen in FIG. 6.

In FIG. 8, a piston 6026 can be seen in the cylinder 1900 and the cable 1920 extends through it, being fastened to it, however, in an airtight manner by suitable connection means 6028 so that the cable 1920 moves with the piston 6026.

As thus described, there are two sections of the cable 1920: 6032 and 6034, which extend away from opposite sides of the piston 6026 to the respective pulleys 5062 and 5070.

First and second seals 6052 and 6062 are disposed at opposite ends of the cylinder 1900 on opposite sides of the piston 6026 and are fixed to the inner sides of the cylinder 1900 by suitable means so that they respectively seal spaces between the cylinder 1900 and the cable 1920. The seals 6052 and 6062 respectively have openings 6054 and 6064 extending horizontally therethrough in alignment with the elongation of the cylinder 1900 and slidably receiving respective portions of the cable 1920 in a slidable manner, but sufficiently tight for effective pneumatic sealing.

The entire machine can be controlled from one cam switch assembly 730 operated by one motor 740 continuously powered by wires 7002, as seen in FIG. 21, or multiple cam assemblies 730 can be used.

The stencil controlling cylinders receive their pneumatic power for lowering and raising the stencil carriers 2010 at the times described, through pneumatic lines 2500 of FIG. 4 which can be seen in FIG. 19 to be connected to a multiple solenoid control value assembly 8020, the latter being connected by lines 8022 to pneumatic lines 702.

The valve assembly 8020 is seen in FIG. 21 to be controlled by two wires 8030 and two other wires 8032 which receive and lose power as controlled by their respective connections to two cam switches, not shown, of the multiple cam switch assembly 730.

The table 70 and its main rotation control mechanism, as described, is a standard product available on the market and known as: Rotating Work Feed Table B3111-004 (10 inches Clockwise Rotation Table, with inline Hydro-Check for gradual slow, easy stopping, and with pneumatic cushioning of stopping) manufactured by: Bellows-Valvair Division of International Basic Economy Corporation, Akron, Ohio 44309.

I claim:

1. A material handling machine for lifting secondary work-pieces from stacks thereof and delivering them to a primary work-piece, said machine comprising a frame, primary and secondary work-piece supports mounted on said frame for movement with respect to each other, a secondary work-piece upholding surface means mounted on said secondary work-piece support and having a first wall assembly thereon at least partially bounding a first stack area and for holding a first vertical stack of said secondary work-pieces in stacked position, a primary work-piece receiving surface means mounted on said primary work-piece support, a secondary work-piece first pick-up assembly mounted on one of said supports, said first pick-up assembly comprising at least a first work-piece-engaging pick-up member having a suction opening therethrough, said first pick-up member having a secondary work-piece-engaging exterior surface surrounding its said suction opening, said first pick-up being adapted to enter said first stack area for engaging a top secondary work-piece on said first stack, said first pick-up assembly having pneumatic conduit means connected to said suction opening at another side of said pick-up member from said secondary work-piece-engaging surface, first controllable pressure reducing means attached to said pneumatic conduit means and reducing the pressure at said suction opening to a lesser pressure than the pressure at the exterior of said first pick-up member whereby when said first pick-up member is in touch with a secondary work-piece the latter is caused to be held by suction against said work-piece-engaging surface of said first pick-up member, said frame having first and second frame sections supporting said primary and secondary work-piece-receiving surface means respectively, a controllable first moving assembly for moving said first pick-up member, said first moving assembly having a transfer portion attached to said first pick-up member and movably mounted on one of said work-piece supports and when activated in a first way moving said first pick-up member from a position above said first stack area to a release location above said primary work-piece receiving area, a first synchronizing control means operably correlated with said first controllable pressure reducing means and causing said lesser pressure to exist when said first pick-up member is above said first stack area and to cease for releasing a secondary work-piece when said first pick-up member is in a certain first release position which latter is above a primary work-piece, said first work-piece support having at least one other secondary work-piece receiving surface means, and a second and similarly describable secondary work-piece pick-up assembly mounted on one of said work-piece supports, means attached to said frame and moving said first and second work-piece supports so that said primary work-piece receiving surface means is moved with respect to said secondary work-piece receiving surface means so as to dispose first one then another of said secondary work-piece receiving surface means in a position adjacent to said primary work-piece receiving surface means automatically in a predetermined sequence.

2. The machine of claim 1 further having a secondary work-piece holding assembly for holding a vertical stack of generally horizontally extending secondary work-pieces which latter are of rectangular shape in top plan view, said wall means being on said holding assembly and said wall means defining four sides of a stack-space rectangular in top plan view, means mounting said stack-space wall means on said second frame section in a position for passage of said work-piece engaging surface of said first pick-up member between said sides of said stack-space wall means.

3. The machine of claim 1 wherein said first pick-up assembly has an upstanding first post assembly, and a first post assembly mounting means mounting said first post assembly on said one of said supports.

4. The machine of claim 1 further having pin means on said first work-piece support for holding thereon in precise positions a plurality of primary work-pieces having pin-receiving openings therein.

5. The machine of claim 3 wherein said first pick-up assembly has a vertically movable elongated upholding means attached to and upholding and vertically moving with its said pick-up member, said upholding means being telescopably mounted on said first post assembly for vertical movement with respect thereto, and a spring correlated with said vertically moving upholding means and said first post assembly and urging said first upholding means downward to resiliently urge its pick-up member downward.

6. The machine of claim 5 further having track follower and track means mounted on different ones respectively of said first post assembly and of said first vertically moving elongated upholding means and guiding the latter into vertical movements yet preventing rotation of the latter with respect to said post assembly so that secondary work-pieces carried by said first pick-up assembly can be delivered to said primary work-piece-receiving surface means with precise positioning.

7. The machine of claim 4 in which said first post assembly is rotatable about a vertical axis so as to swing said pick-up member in a secondary work-piece delivery rotational motion from a first pick-up position adjacent said first stack area over to a first release position above said primary work-piece-receiving surface means, said first post assembly mounting means causing said first post assembly to rotate about said axis for causing said first pick-up member to define said first delivery motion, said first post assembly mounting means having as one of its portions a first post assembly vertical position control means causing said first post assembly to cause said first pick-up member to move upward from said first pick-up position and to remain upward during said swinging thereof and then to lower into said first delivery position.

8. The machine of claim 1 further having a positioning assembly having a first section mounted on one of said supports and other spaced sections mounted on the other of said supports, said first positioning assembly section controllably engaging and disengaging whatever one of said other spaced positioning member sections it is adjacent, and means automatically causing said latter engagements whenever one of said secondary work-piece-receiving surface means is first disposed opposite said primary work-piece-engaging surface means and causing said latter disengagements prior to a movement of said supports with respect to each other.

9. The machine of claim 1 further having a gluing assembly comprising gluing means delivering glue to the area of said primary work-piece-receiving surface means for engaging a primary work-piece at times when said supports are stationary with respect to each other.

10. The machine of claim 9 in which said gluing assembly has a stencil with multiple openings in it and has a moving roller intermittently applying glue through said stencil openings when a primary work-piece supporting surface is opposite said gluing assembly.

11. The machine of claim 1 further having a primary work-piece feed stack holding means mounted on a certain one of said supports, a primary work-piece feed pick-up assembly mounted on said certain support and moving primary work-pieces from said primary work-piece feed stack holding means on said certain support over to the other of said supports.

12. The machine of claim 1 further having a primary work-piece finished stack holding means mounted on said certain one of said supports, a finished primary work-piece removal pick-up assembly mounted on said certain support and moving primary work-pieces to said primary work-piece finished holding means on said certain support from the other of said supports.

13. The machine of claim 10 in which said gluing assembly has a frame and said roller has a roller frame mounted on the gluing assembly frame in a manner for reciprocation with respect thereto and reciprocating across said stencil for applying glue therethrough, a pair of cables connected to said roller frame and extending over inner and outer pulleys spaced apart along the pathway of reciprocating movement of said roller, a pneumatic cylinder mounted on said gluing assembly frame and having a piston therein, said cables extending from upper sides of each of said pulleys respectively each into an opposite end of said cylinder and each being connected to an opposite side of said piston, and first and second sealing means disposed at opposite ends of said cylinder and sealing the space between respective ones of said cables on the inner side of said cylinder and slidably receiving said cables snugly therethrough for maintaining pneumatic pressure at desired times in said cylinder.

14. The machine of claim 1 further having a secondary work-piece holding assembly for holding a vertical stack of generally horizontally extending secondary work-pieces which latter are of rectangular shape in top plan view, said holding assembly having upwardly extending wall means, as seen in top plan view said wall means being disposed on four sides of a stack space rectangular in top plan view, means mounting said wall means on said secondary work-piece support in a position for passage of said work-piece engaging surface of said first pick-up member between said sides of said stack-space wall means.

15. The machine of claim 1 wherein said first pick-up assembly has a first post assembly having a first upstanding post, and a first post mounting means mounting said first post on said one of said supports.

16. The machine of claim 1 further having at least two pins attached to and extending upwardly from said first work-piece support for holding thereon in precise positions a plurality of primary work-pieces having pin-receiving openings therein.

17. The machine of claim 15 wherein said first pick-up assembly has a vertically movable elongated upholding means attached to and upholding and vertically moving with and disposed above its said pick-up member, upholding means mounting means mounting said upholding means on said first post assembly telescopically for vertical movement with respect to said first post assembly, and a spring correlated with said vertically moving upholding means and said first post assembly and urging said upholding means downward to resiliently urge its pick-up member downward.

18. The machine of claim 16 in which said upholding means is horizontally spaced from said first post and said first post is rotatable about a vertical axis so as to swing said pick-up member in a secondary work-piece delivery rotation motion from a first pick-up position adjacent said first stack area over to a first release position above said primary work-piece-receiving surface means, said first post mounting means causing said first post to rotate about said axis for causing said first pick-up member to define said first delivery motion, said first post mounting means having as one of its portions a first post vertical position control means connected to said first post and to said frame and causing said first post assembly to cause said first pick-up member to move upward from said first pick-up position and to remain upward during said swinging thereof and then to lower into said delivery position.

19. The machine of claim 1 further havng a positioning assembly having a first section mounted on one of said supports and other spaced sections mounted on the other of said supports, said first positioning assembly section controllably initially moving toward and engaging said spaced positioning member sections one at a time as said positioning member sections are sequentially positioned opposite said first positioning member section whenever one of said secondary work-piece-receiving surface means and one of said primary work-piece-engaging surface means are disposed opposite each other, and said first positioning assembly section moving away from and out of the way of said other positioning assembly sections respectively prior to a movement of said supports with respect to each other, said first section and other sections of said positioning assembly having mutually engaging surfaces which latter are disposed in positions for guiding said first sections and each respective other section into precise positions with respect to each other laterally of the direction of relative movement of said supports as said first section and each sequential one of said other sections are moved towards each other respectively whereby said precise positioning of said first and other positioning assembly sections with respect to each other causes precise positionings of said supports with respect to each other.

20. The machine of claim 1 further having a gluing assembly having a gluing assembly frame mounted on said secondary work-piece support, gluing means mounted on said gluing assembly frame and delivering glue to the area of said primary work-piece-receiving surface means for applying glue to a primary work-piece at times when said supports are stationary with respect to each other.

21. The machine of claim 20 in which said gluing assembly has a glue supply means, a stencil with multiple openings in it, a roller movably mounted on said glue assembly frame and intermittently rolling across said stencil and applying glue through said stencil openings when a primary work-piece supporting surface is opposite said gluing assembly.

22. The machine of claim 21 in which said glue assembly frame is slidably mounted on said secondary work-piece support and is movable toward and away from a primary work-piece supporting surface means which it is opposite.

23. The machine of claim 1 further having a primary work-piece feed stack holding means mounted on said secondary work-piece support, a primary work-piece feed pick-up assembly of a general description similar to said first pick-up assembly and mounted on said primary work-piece support and moving primary work-pieces from said primary work-piece feed stack holding means over to said primary work-piece support.

24. The machine of claim 1 further having a primary work-piece finished stack holding means mounted on said secondary work-piece support, a finished primary work-piece removal pick-up assembly of a general description similar to said first pick-up assembly and mounted on said secondary work-piece support and moving primary work-pieces to said primary work-piece finished stack holding means from said primary work-piece support.

* * * * *